US008703376B2

(12) United States Patent
Yamada et al.

(10) Patent No.: US 8,703,376 B2
(45) Date of Patent: Apr. 22, 2014

(54) TONER AND DEVELOPER

(75) Inventors: Saori Yamada, Numazu (JP); Shinya Nakayama, Numazu (JP); Hisashi Nakajima, Numazu (JP); Mitsuo Aoki, Numazu (JP); Hyo Shu, Numazu (JP); Hiroyuki Kishida, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 12/624,714

(22) Filed: Nov. 24, 2009

(65) Prior Publication Data

US 2010/0136471 A1 Jun. 3, 2010

(30) Foreign Application Priority Data

Nov. 28, 2008 (JP) ..... 2008-304797
Jan. 14, 2009 (JP) ..... 2009-005823

(51) Int. Cl.
*G03G 9/087* (2006.01)
*G03G 13/20* (2006.01)

(52) U.S. Cl.
USPC ..... 430/109.4; 430/124.1

(58) Field of Classification Search
USPC ..... 430/109.4, 124.1
See application file for complete search history.

(56) References Cited

U.S. PATENT DOCUMENTS

| | | | | |
|---|---|---|---|---|
| 7,521,164 | B2 | 4/2009 | Nakayama et al. | |
| 2006/0210903 | A1* | 9/2006 | Ohki et al. | 430/109.4 |
| 2007/0248380 | A1* | 10/2007 | Iwamoto et al. | 399/130 |
| 2008/0280218 | A1 | 11/2008 | Sabu et al. | |
| 2008/0280219 | A1 | 11/2008 | Nakayama et al. | |
| 2008/0318143 | A1 | 12/2008 | Nakayama et al. | |
| 2009/0103950 | A1 | 4/2009 | Nakayama et al. | |
| 2009/0117485 | A1* | 5/2009 | Kimura et al. | 430/109.4 |

FOREIGN PATENT DOCUMENTS

| | | | |
|---|---|---|---|
| JP | 4-70765 | | 3/1992 |
| JP | 4-307557 | | 10/1992 |
| JP | 7-128911 | | 5/1995 |
| JP | 8-54755 | | 2/1996 |
| JP | 2002-365843 | | 12/2002 |
| JP | 2003-5432 | | 1/2003 |
| JP | 2003-255611 | | 9/2003 |
| JP | 2007-137910 | | 6/2007 |
| JP | 2007-139811 | | 6/2007 |
| JP | 2007-139812 | | 6/2007 |
| JP | 2007-240831 | | 9/2007 |
| JP | 2007-292792 | | 11/2007 |
| JP | 2007-292815 | | 11/2007 |
| JP | 2007-310329 | | 11/2007 |
| JP | 2007-322927 | | 12/2007 |
| JP | 2009-103745 | | 5/2009 |
| JP | 2009098535 | A * | 5/2009 |
| JP | 2009103749 | A * | 5/2009 |
| JP | 2009116320 | A * | 5/2009 |
| JP | 2009258477 | A * | 11/2009 |

OTHER PUBLICATIONS

U.S. Appl. No. 12/557,105, filed Sep. 10, 2009, Nakajima, et al.
Japanese Office Action issued Jan. 8, 2013, in Patent Application No. 2009-005823.

* cited by examiner

*Primary Examiner* — Jonathan Jelsma
(74) *Attorney, Agent, or Firm* — Oblon, Spivak, McClelland, Maier & Neustadt, L.L.P.

(57) ABSTRACT

A toner, wherein a binder resin contains a polyester resin (A) produced by polycondensing an alcohol component with a carboxylic acid component which contains a rosin compound in an amount of 5% by mass or more of the total amount by mass of the alcohol component and the carboxylic acid component, and a polyester resin (B) produced by polycondensing an alcohol component containing an alkylene oxide adduct of bisphenol A represented by General Formula (1) given below with a carboxylic acid component, and wherein the toner contains abietic acid in an amount of 0.01% by mass to 1% by mass:

General Formula (1)

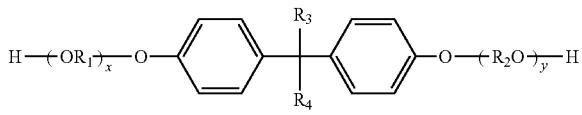

where $R_1$ and $R_2$ each represent C2-C4 alkylene; $R_3$ and $R_4$ are each any one of a hydrogen atom, C1-C6 straight-chain alkyl, and C1-C6 branched-chain alkyl; and x and y each represent a positive integer and the sum of x and y is 1 to 16.

13 Claims, No Drawings

TONER AND DEVELOPER

BACKGROUND OF THE INVENTION

1. Field of the Invention

The present invention relates to a toner suitable for use in copiers, electrostatic printing systems, printers, facsimiles, and electrophotographic systems such as electrostatic recording systems, and especially in a super-high-speed printing system which can be used in print-on-demand (POD) technology, as well as to a developer containing the toner.

2. Description of the Related Art

In recent years, market demands for energy saving and higher speed processing have increased for image forming apparatuses such as printers, copiers, and facsimiles. With the increase of such market demands, also in the field of electrophotographic toner (hereinafter, may be simply referred to as "toner"), a demand for a toner having excellent low-temperature fixability increases, while there is a need for a toner having conflicting properties to the low-temperature fixability such as offset resistance and heat resistant storage stability (blocking resistance). Particularly in toners produced through pulverization, a polyester resin advantageous in enhancing low-temperature fixability is increasingly used for a toner binder. However, particles produced using such polyester resin often has lower pulverizability than particles produced using a conventional styrene-acrylic resin, and thus such polyester resin has been disadvantageous in reduction of the particle size of the resultant toners, which reduction would have enhanced toner productivity and image quality.

Aiming to solve these problems, a toner containing a non-linear cross-linked polyester resin, which is produced using a rosin for an acid component, has been reported as being a toner which has excellent low-temperature fixability and which can achieve both hot-offset resistance and heat resistant storage stability (see Japanese Patent Application Laid-Open (JP-A) No. 04-70765). Alternatively, there has been a toner containing a polyester resin which uses a purified rosin and an acid-modified rosin and, thereby, solves odor-related problems and improves heat resistant storage stability (see JP-A No. 2007-137910, JP-A No. 2007-292815, and JP-A No. 04-307557).

As a result of the incorporation of such rosin skeletons, the polyester resin used in these toners becomes hard and brittle, and excellent in pulverizability, however, becomes poor in mechanical durability. Consequently, some of the toner particles break by stirring stress within a developing apparatus and thereby lower toner's function, and, further, carriers and the inside of the developing apparatus are contaminated by the broken fine toner particles, resulting in significantly reduced developing performance.

On the other hand, in JP-A No. 2007-139811 and JP-A No. 2007-139812 toners which incorporate a purified rosin and bisphenol A structure for enhancement of the durability of the toners has been reported, however, these toners have not solved the above problems.

Meanwhile, in JP-A No. 08-54755, it is reported that electrostatic chargeability and development ability are improved by using a so-called capsule toner which is composed of core substances and an outer shell and which contains a colorant treated with a natural rosin or a rosin such as an abietic acid derivative in the core substances.

In addition, in JP-A No. 07-128911, it is reported that a color toner, incorporating a colorant surface-treated with abietic acid, becomes excellent in transfer efficiency, cleaning property, and charging stability, and able to achieve excellent full color images.

In these toners, rosin derivatives of heteroaromatic rings such as abietic acid derivatives of heteroaromatic rings are used, which in fact improves dispersibility of the colorants and achieves initial excellent transfer efficiency and charging stability. However, these rosin derivatives are low-molecular-weight substances and are not chemically bound to a binder resin, therefore, under friction caused by an image forming apparatus some of the toner particles that contain a significant amount of the low-molecular-weight rosin derivatives are likely to adhere to carriers in two-component developing systems and to a charge roller in one-component developing systems, leading to gradual loss of development ability.

In addition, when a fixing step is carried out by a contact heating system using a heating member such as heating roller, a high level of toner release property of a releasing agent from the heating member (hereinafter, may be referred to as "offset resistance") is required. The offset resistance may be enhanced by disposing the releasing agent on the surface of a toner particle. For the enhancement of such offset resistance, the releasing agent may be contained in the toner particle before exuding on the surface of the toner particle, and thus the toner release property of the releasing agent is largely influenced by the state of the releasing agent in the toner particle. The releasing agent is preferably homogeneously dispersed in the toner particle in terms of stabilization of its quality. However, the dispersion diameter of the releasing agent in the toner particle cannot be reduced unlimitedly but preferably has a suitable value, because when the releasing agent has an excessively fine dispersion diameter it becomes difficult for the releasing agent to exude on the surface of the toner particle at the time of heating. A polyester resin produced using an aliphatic alcohol is highly compatible with general releasing agents, thus making less effective the toner release property of the releasing agents. The polyester resin produced by using an aliphatic alcohol is, however, very rigid due to its structure and can have a slightly high molecular weight at a fixed fixing temperature, and therefore tends to be superior in heat resistant storage stability to a styrene-acrylic resin. A styrene-acrylic resin, on the other hand, must have a low-molecular-weight to be able to melt at a low temperature, which makes the resin brittle and degrades the heat resistant storage stability of the resin. However, the styrene-acrylic resin is cheap and has large freedom of structural design such as in selecting a functional group, which freedom makes it easy to control the compatibility with the above-mentioned releasing agents.

Consequently, a variety of methods in which the styrene-acrylic resin and the polyester resin are mixed for use are proposed (JP-A No. 2003-255611; JP-A No. 2003-5432; JP-A No. 2002-365843). However, in these proposed toners the styrene-acrylic resin is less compatible with the polyester resin, causing separation between the two resins in the toner, thereby easily causing carrier contamination with resin components and alteration in physical properties.

In recent years, the market of the print-on-demand (POD) field has grown substantially, and printing market becomes in need of further sophisticated toners. The POD technology utilizing an electrophotographic printing method is well suited for printing a small number of copies and for variable printing and thus is greatly expected as an alternative to simple printing technology ("keiinsatu"). When the electrophotographic printing technology is used in the POD system, so as to operate under high linear speed conditions, the electrophotographic printing technology requires highly sophisticated low-temperature fixing technology.

In the meanwhile, since the POD systems are used in printing market, there is a need to achieve the electrophotographic process with substantially longer operating life than conventional electrophotographic systems for office use and domestic use. In particular, when fixing devices, which are members to be abraded most remarkably among members used in electrophotographic systems, have a short operating life, the outage of the printing machine itself is prolonged due to the replacement with a new fixing device, leading to degradation in printing capability. Thus, achieving longer operating life of POD systems is one of the important subjects to be addressed. The POD system is designed for achieving long operating life and therefore the toner consumption amount per POD system unit will be significantly large. Therefore, at present, the toners used in POD systems require to be more greatly improved, for decreasing abrasion rate of the fixing members, than toners used in conventional electrophotographic systems.

BRIEF SUMMARY OF THE INVENTION

An object of the present invention is to solve the problems of the related art and to achieve the following purposes: to provide a toner which is capable of achieving low-temperature fixability, offset resistance and heat resistant storage stability, which is further excellent in achieving dispersibility of pigments and achieving smear resistance on developing rollers and the like in super-high-speed image forming systems, and to provide a developer using the toner, wherein the level of the capability of achieving low-temperature fixability, offset resistance, and heat resistant storage ability is such that the capability can be used in the super-high-speed image forming systems.

Means for solving the aforementioned problems are as follows:

<1> A toner containing at least a binder resin, a releasing agent, and a colorant, wherein the binder resin comprises a polyester resin (A) which is produced by polycondensing an alcohol component with a carboxylic acid component which contains a rosin compound in an amount of 5% by mass or more of the total amount by mass of the alcohol component and carboxylic acid component, and a polyester resin (B) which is produced by polycondensing an alcohol component containing an alkylene oxide adduct of bisphenol A represented by General Formula (1) given below with a carboxylic acid component, and wherein the toner contains abietic acid in an amount of 0.01% by mass to 1% by mass:

General Formula (1)

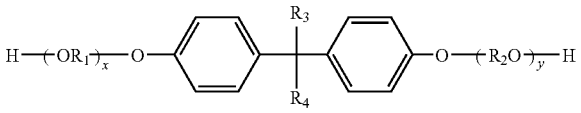

where $R_1$ and $R_2$ each represent a C2-C4 alkylene group; $R_3$ and $R_4$ are each any one of a hydrogen atom, a C1-C6 straight-chain alkyl group, and a C1-C6 branched-chain alkyl group; and x and y each represent a positive integer and the sum of x and y is 1 to 16.

<2> The toner according to <1>, wherein the alcohol component of the polyester resin (A) contains an aliphatic diol in an amount of 65 mole % or more of a divalent alcohol component.

<3> The toner according to <2>, wherein the aliphatic diol contains 1,2-propanediol in an amount of 65 mole % or more.

<4> The toner according to any one of <1> to <3>, wherein the carboxylic acid component of the polyester resin (A) further contains an aromatic dicarboxylic acid compound.

<5> The toner according to any one of <1> to <4>, wherein the polyester resin (B) is produced by polycondensing an alcohol component which contains the alkylene oxide adduct of bisphenol A represented by General Formula (1) in an amount of 80 mole % or more of a divalent alcohol component with a carboxylic acid component.

<6> The toner according to any one of <1> to <5>, wherein the polyester resin (A) has an acid value of 25 mgKOH/g to 70 mgKOH/g and the polyester resin (B) has an acid value of 1 mgKOH/g to 25 mgKOH/g.

<7> The toner according to any one of <1> to <6>, wherein a mass ratio [(B)/(A)] of the polyester resin (B) to the polyester resin (A) is 1/9 to 6/4.

<8> The toner according to any one of <1> to <7>, wherein the polyester resin (A) contains a low-molecular-weight component having a molecular weight of 500 or less in an amount of 12% or less.

<9> A developer containing at least the toner according to any one of <1> to <8> and a carrier.

According to the present invention, the problems of the related art may be solved, and it may be provided a toner which is capable of achieving low-temperature fixability, offset resistance, and heat resistant storage stability, which is further excellent in achieving dispersibility of pigments and achieving smear resistance on developing rollers and the like in super-high-speed image forming systems, and may be provided a developer using the toner, wherein the level of the capability of achieving low-temperature fixability, offset resistance, and heat resistant storage ability is such that the capability may be used in the super-high-speed image forming systems.

DETAILED DESCRIPTION OF THE INVENTION

Toner

A toner of the present invention contains at least a binder resin, a releasing agent and a colorant, contains a charge control agent and an external additive, and further contains additional components as required.

There can be provided a toner which is capable of achieving low-temperature fixability, offset resistance, and heat resistant storage stability, which is further excellent in achieving smear resistance on developing rollers and the like in super-high-speed image forming systems and achieving dispersibility of pigments, and can be provided a developer using the toner, only through combined use of a polyester resin (A) and a polyester resin (B) in the toner in the present invention. Although the precise mechanism is unknown, possibly due to dispersing in a microphase-separated state the polyester resin (B) containing a bisphenol A skeleton with high mechanical strength in the polyester resin (A), which is produced by polycondensing an alcohol component with a carboxylic acid component which contains a rosin compound in an amount of 5% by mass or more of the total amount of the alcohol component and the carboxylic acid component, in the toner product, the fixability and pulverizability of the polyester resin (A), remain effective, and the heat resistant storage stability and smear resistance on developing rollers and the like are enhanced through the polyester resin (B) containing a bisphenol A skeleton with high mechanical strength.

Therefore, the operation and effect of the present invention provided by using the binder resin containing the polyester resin (A) and the polyester resin (B) may not be obtained when only a binder resin containing both a rosin skeleton and a bisphenol skeleton in a resin molecule of a binder resin is used.

Furthermore, in the present invention, in order to obtain excellent dispersibility of a pigment in the toner, the amount of abietic acid in the toner is 0.01% by mass to 1% by mass, preferably 0.02% by mass to 0.5% by mass, and more preferably 0.05% by mass to 0.1% by mass. The dispersibility of a pigment in the toner is believed to be improved by the incorporation of abietic acid in the toner in which the polyester resin (A) and the polyester resin (B), which are different in dispersibility of the pigment, are combined for use. Examples of a method of adjusting the amount of abietic acid in the toner include a method of adding abietic acid at the time of production of the toner and a method of adjusting the amount of abietic acid in the polyester resin (A) to a predetermined amount. When the amount of abietic acid in the toner is more than 1% by mass, a developing roller and the like becomes easy to be smeared with the toner in super-high-speed image forming systems. When the amount of abietic acid in the toner is less than 0.01% by mass, the dispersibility of a pigment is degraded and the hue and saturation of image colors are degraded.

<Binder Resin>

The binder resin contains a polyester resin (A) and a polyester resin (B) and further contains additional resins as required.

—Polyester Resin (A)—

According to the present invention, suitable dispersion of a releasing agent is achieved by introduction of a rosin skeleton into a polyester resin (A), and thereby a toner excellent in low-temperature fixability, hot-offset resistance, and heat resistant storage stability may be obtained. Furthermore, according to the present invention, abietic acid is contained in the toner in an amount of 0.01% by mass to 1% by mass, by which a toner excellent in dispersibility of a pigment may be produced.

The rosin compounds contained in carboxylic acid components of the polyester resin (A) include abietic acid as a main component. Examples of a method for adjusting the amount of abietic acid in the above polyester resin (A) so as to produce a predetermined range of concentrations thereof include: a method of use of a reactive aliphatic diol for an alcohol component of the polyester resin (A) to increase the reaction rate of rosin compounds; a method of use of a modified rosin in which the amount of abietic acid has been previously adjusted by modification reaction with an unsaturated fatty acid; a method of increase of the reaction rate of rosin compounds by adjusting reaction time, reaction temperature, and level of depressurization in the production reaction of the polyester resin; and a method of removal of a low-molecular-weight component contained in the polyester resin (A) by steam distillation and water-droplet spray treatment thereof after the completion of the reaction of monomers. Alternatively, the above-mentioned examples include a method of use of an aliphatic diol for an alcohol component wherein both of the two hydroxyl groups of the aliphatic diol are primary hydroxyl groups.

—Alcohol Component—

As mentioned above, an alcohol component of the polyester resin (A) is preferably an aliphatic diol. It becomes possible to adjust the amount of abietic acid if the aliphatic diol, which is more reactive than an aromatic alcohol, is used for the alcohol component, leading to easier incorporation of rosin compounds into the polyester resin. Furthermore, it becomes easy to incorporate the rosin compounds into the polyester resin if initially the rosin compounds are added into the reaction system with the aliphatic alcohol to react the rosin compounds with the aliphatic alcohol.

The aliphatic diol is, for example, ethylene glycol, 1,2-propanediol, and 1,3-propanediol, and is preferably a C2-C6 aliphatic alcohol from the viewpoints of maintaining a high resin glass transition temperature and securing toner storage stability. These aliphatic alcohols are used alone or in combination.

Furthermore, from the viewpoints of maintaining a high resin glass transition temperature and securing toner storage stability, the aliphatic alcohol is preferably 1,2-propanediol. 1,2-Propanediol, which is a C3 alcohol having a secondary hydroxyl group, is more effective in preventing the decrease of the glass transition temperature and toner storage stability of the resin than C4 or higher alcohols having a secondary hydroxyl groups. The amount of 1,2-propanediol in the aliphatic diols is preferably 65 mole % or more, more preferably 70 mole % or more, and still more preferably 80 mole % to 100 mole %.

When an unmodified rosin compound is used for a rosin compound to be hereinafter described, from the viewpoint of reactivity, preferably the alcohol components contain an aliphatic diol whose two hydroxyl groups are both primary hydroxyl groups (such as 1,3-propanediol) along with 1,2-propanediol, in an amount of preferably 30 mole % or less of the aliphatic diols, and more preferably 10 mole % to 20 mole % of the aliphatic alcohols.

The amount of the aliphatic diols in the divalent alcohol components is preferably 65 mole % or more, and more preferably 80 mole % to 100 mole %.

Examples of a divalent alcohol component other than the above-mentioned aliphatic alcohols include aromatic alcohols such as alkylene oxide adducts of bisphenol A, e.g. polyoxypropylene-2,2-bis (4-hydroxyphenyl) propane, and polyoxyethylene-2,2-bis(4-hydroxyphenyl) propane; and a hydrogenated bisphenol A or alkylene (C2 to C4) oxide adducts (1 to 16 moles of the oxide are added by an adduct molecule on average) thereof.

The amount of the above-mentioned divalent alcohol components in the alcohol components is preferably 60 mole % to 100 mole %, more preferably 60 mole % to 95 mole %, and still more preferably 65 mole % to 90 mole %.

—Carboxylic Acid Component—

As mentioned above, the carboxylic acid components include a rosin compound.

In the present invention, a "rosin" is a natural resin obtained from turpentine, and the primary component is resin acids such as abietic acid, neoabietic acid, palustric acid, pimaric acid, isopimaric acid, sandaracopimaric acid, dehydroabietic acid, and levopimaric acid, or a mixture thereof.

The rosins used in the present invention include natural rosins which are broadly classified into three types of rosins: tall rosins derived from tall oils which are by-products obtained from production process of wood pulp, gum rosins obtained from turpentine, and wood rosins obtained from pine stumps; and include modified rosins such as isomerized rosins, dimerized rosins, polymerized rosins, disproportionated rosins, and hydrogenated rosins; however in the present invention, are preferably modified rosins in which rosins have been modified with an unsaturated fatty acid and thereby the amount of abietic acid has been previously adjusted.

The unsaturated fatty acid modified rosin is obtained by addition reaction between a rosin and an unsaturated fatty acid, specifically may be obtained through Diels-Alder reaction or en reaction, under heat treatment, between rosin primary components having a conjugated double bond, that is levopimaric acid, abietic acid, neoabietic acid, and palustric acid, and an unsaturated fatty acid.

Rosins to be modified may be the above-mentioned known rosins, however, are preferably natural rosins from the viewpoint of color, and more preferably tall rosins from the viewpoint of low-temperature fixability.

Examples of the unsaturated fatty acid for modifying the rosins include (meth)acrylic acid, maleic acid, maleic anhydride, fumaric acid, and itaconic acid.

Furthermore, from the viewpoints of low-temperature fixability, hot-offset resistance, and heat resistant storage stability, the amount of a low-molecular-weight component having a molecular weight of 500 or less, attributable to a residual monomer component or oligomer component, in the polyester resin, is preferably 12% or less, more preferably 10% or less, and still more preferably 9% or less, and particularly preferably 8% or less. The amount of the low-molecular-weight component in the polyester resin can be calculated based on an area ratio of peaks in the molecular weight ranges as determined by gel permeation chromatography (GPC) described below.

The method for producing the modified rosins with the unsaturated fatty acids is not particularly limited, may be suitably selected depending on the purpose, and is, for example, a method by which a rosin and an unsaturated fatty acid are mixed, and heated to a temperature of 180° C. to 260° C. to produce the modified rosin by Diels-Alder reaction or en reaction, which is an addition reaction, between an acid having a conjugated double bond which acid is contained in the rosin, and an unsaturated fatty acid. The modified rosins thus obtained may be used directly, or used further after they have been purified by such operation as distillation.

The amount of the rosin compound in the total amount of the alcohol component and the carboxylic acid component is 5% by mass or more, preferably 5% by mass to 40% by mass, more preferably 10% by mass to 40% by mass, still more preferably 15% by mass to 40% by mass, and particularly preferably 25% by mass to 40% by mass.

From the viewpoint of attainment of high glass transition temperature of a resin obtained, carboxylic acid component other than the rosin compound is preferably an aromatic dicarboxylic acid compound such as phthalic acid, isophthalic acid, and terephthalic acid. The amount of the aromatic dicarboxylic acid compound per 100 moles of the alcohol component is preferably 40 moles to 95 moles, more preferably 50 moles to 90 moles, and still more preferably 60 moles to 80 moles. Note that carboxylic acids, carboxylic acid anhydrides, and alkylesters of carboxylic acid in the present invention are herein collectively referred to as carboxylic acid compounds.

The alcohol components and/or the carboxylic acid components may contain a trivalent or higher monomer as a basic ingredient. The amount of the trivalent or higher monomer as a basic ingredient per 100 moles of the divalent alcohol component is preferably 40 moles or less, and more preferably 5 moles to 30 moles.

As to the trivalent or higher monomer as a basic ingredient, the trivalent or higher polyvalent carboxylic acid is preferably trimellitic acid or a derivative thereof, and examples of the trivalent or higher polyvalent alcohol include glycerin, pentaerythritol, trimethylolpropane, sorbitol, or an alkylene (C2 to C4) oxide adduct (1 to 16 moles of the oxide are added by an adduct molecule on average) thereof, among these, glycerin is particularly preferable because of effectiveness in improving low-temperature fixability.

—Polyester Resin (B)—

The binder resin for use in the toner of the present invention uses a polyester resin (B) in combination with the above-mentioned polyester resin (A). Effects derived from respective resins in the binder resin can synergistically work, and the effects of the present invention can be optimally exhibited only after these resins are used in combination.

The polyester resin (B) is produced by polycondensing an alcohol component containing an alkylene oxide adduct of bisphenol A represented by the following General Formula (1) with a carboxylic acid component:

General Formula (1)

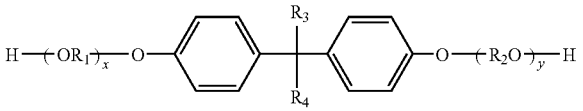

where $R_1$ and $R_2$ each represent a C2-C4 alkylene group such as ethylene and propylene; $R_3$ and $R_4$ are each any one of a hydrogen atom, a C1-C6 straight-chain alkyl group, and a C1-C6 branched-chain alkyl group, and examples thereof include methyl, ethyl, propyl, isopropyl, butyl, t-butyl, and hexyl, and particularly preferred examples thereof are a hydrogen atom and a methyl group; and x and y each represent a positive integer and the sum of x and y is 1 to 16, and preferably 2 to 6.

—Alcohol Component—

As the alkylene oxide adduct of a bisphenol compound represented by General Formula (1), as an alcohol component of the polyester resin (B), for example, diols obtained by polymerization of a cyclic ether such as ethylene oxide and propylene oxide of bisphenol A, bisphenol F and the like are exemplified.

The alcohol component of the polyester resin (B) may contain alcohols other than the compound represented by General Formula (1) within the range where the object and interaction effects of the present invention are not impaired. The amount of the alkylene oxide adduct of a bisphenol compound represented by General Formula (1) contained in a divalent alcohol component is preferably 80 mole % or more.

—Carboxylic Acid Component—

The carboxylic acid component of the polyester resin (B) is not particularly limited and may be suitably selected in accordance with the intended use. Examples of the carboxylic acid component of the polyester resin (B) include benzene dicarboxylic acids such as phthalic acid, isophthalic acid, and terephthalic acid or anhydrides thereof alkyl dicarboxylic acids such as succinic acid, adipic acid, sebacic acid, and azelaic acid or anhydrides thereof unsaturated dibasic acids such as maleic acid, citraconic acid, itaconic acid, alkenylsuccinic acid, fumaric acid, and mesaconic acid; and unsaturated dibasic anhydrides such as maleic anhydride, citraconic anhydride, itaconic anhydride, and alkenylsuccinic anhydride.

Examples of trivalent or higher polyvalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylene carboxypropane, tetra(methylenecarboxy)methane, 1,2,7,8-octanetetracarboxylic acid, Enpol trimer acid, or anhydrides thereof, or partially lower alkyl esters thereof.

Among these, from the viewpoints of heat resistant storage stability and mechanical strength of the resin, the carboxylic acid component of the polyester resin (B) preferably include an aromatic polyvalent carboxylic acid compound such as phthalic acid, isophthalic acid, terephthalic acid and trimellitic acid. The amount of the aromatic polyvalent carboxylic acid compound contained in the carboxylic acid components is preferably 40 mole % to 95 mole %, more preferably 50 mole % to 90 mole %, and still more preferably 60 mole % to 80 mole %.

—Esterification Catalyst—

It is preferable that the polycondensation of the alcohol components and the carboxylic acid components of the polyester resin (A) and the polyester resin (B) be carried out in the presence of an esterification catalyst.

Examples of the esterification catalyst include Lewis acids such as p-toluene sulfonic acid; titanium compounds, and tin (II) compounds having no Sn—C bond. These esterification catalysts are used alone or in combination of two of them. In the present invention, a titanium compound and/or a tin (II) compound having no Sn—C bond are preferably used.

As the titanium compound, preferred is a titanium compound having a Ti—O bond, and a titanium compound having an alkoxy group, an alkenyloxy group or acyloxy group each of which has carbon atoms in total of 1 to 28 is more preferable.

Examples of the titanium compound include titanium diisopropylate bis-triethanolaminate [$Ti(C_6H_{14}O_3N)_2(C_3H_7O)_2$], titanium diisopropylate bis-diethanolaminate [$Ti(C_4H_{10}O_2N)_2(C_3H_7O)_2$], titaniumdipentylate-bis triethanolaminate [$Ti(C_6H_{14}O_3N)_2(C_5H_{11}O)_2$], titaniumdiethylate bis triethanolaminate [$Ti(C_6H_{14}O_3N)_2(C_2H_5O)_2$], titaniumdihydroxy octylate-bis triethanolaminate [$Ti(C_6H_{14}O_3N)_2(OHC_8H_{16}O)_2$], titaniumdistearate-bis triethanolaminate [$Ti(C_6H_{14}O_3N)_2(C_{18}H_{37}O)_2$], titanium triisopropylate triethanolaminate [$Ti(C_6H_{14}O_3N)_1(C_3H_7O)_3$], and titanium monopropylate tris(triethanolaminate) [$Ti(C_6H_{14}O_3N)_3(C_3H_7O)_1$]. Among these, titanium diisopropylate bis-triethanolaminate, titanium diisopropylate bis-diethanolaminate and titanium dipentylate-bis triethanolaminate are preferable, and these compounds are available as commercial products from Matsumoto Trading Co., Ltd.

Specific examples of other preferred titanium compounds include tetra-n-butyltitanate [$Ti(C_4H_9O)_4$], tetrapropyl titanate [$Ti(C_3H_7O)_4$], tetrastearyl titanate [$Ti(C_{18}H_{37}O)_4$], tetra tetramyristyl titanate [$Ti(C_{14}H_{29}O)_4$], tetraoctyl titanate [$Ti(C_8H_{17}O)_4$], dioctyl dihydroxy octyl titanate [$Ti(C_8H_{17}O)_2(OHC_8H_{16}O)_2$], and dimyristyl dioctyltitanate [$Ti(C_{14}H_{29}O)_2(C_8H_{17}O)_2$]. Among these, preferred are tetrastearyl titanate, tetramyristyl titanate, tetraoctyl titanate, and dioctyl dihydroxyoctyl titanate. These can be obtained, for example, by reacting a titanium halide with the corresponding alcohol or are available from Nisso Co. Ltd. as commercial products.

The amount of the titanium compound present relative to 100 parts by mass of the total amount of the alcohol components and the carboxylic acid components is preferably 0.01 parts by mass to 1.0 part by mass, and more preferably 0.1 parts by mass to 0.7 parts by mass.

As the tin (II) compound having no Sn—C bond, preferred are a tin (II) compound having an Sn—O bond, a tin (II) compound having an Sn—X (where X represents a halogen atom) bond, and the like; and a tin (II) compound having an Sn—O bond is more preferable.

Examples of the tin (II) compound having an Sn—O bond include, for example, tin (II) carboxylates having carboxylic acid groups with 2 to 28 carbon atoms, such as tin (II) oxalate, tin (II) diacetate, tin (II) dioctanoate, tin (II) dilaurate, tin (II) distearate, and tin (II) dioleate; dialkoxy tin (II) having alkoxy groups with 2 to 28 carbon atoms, such as dioctyloxy tin (II), dilauryoxy tin (II), distearoxy tin (II), and dioleyloxy tin (II); tin (II) oxides; and tin (II) sulfates. Examples of the tin (II) compound having an Sn—X (where X represents a halogen atom) bond include halogenated tin (II) such as tin (II) chlorides, tin (II) bromides. Among these, in terms of charge start-up characteristics and catalytic capacity, fatty acid tin (II) represented by $(R^1COO)_2Sn$ (where $R^1$ represents an alkyl group or alkenyl group having 5 to 19 carbon atoms), dialkoxy tin (II) represented by $(R^2O)_2Sn$ (where $R^2$ represents an alkyl group or alkenyl group having 6 to 20 carbon atoms), and tin (II) oxides represented by SnO are preferable; fatty acid tin (II) represented by $(R^1COO)_2Sn$ and tin (II) oxides being more preferable; and tin (II) dioctanoate, tin (II) distearate and tin (II) oxides are still more preferable.

The amount of the tin (II) compound present relative to 100 parts by mass of the total amount of the alcohol components and the carboxylic acid components is preferably 0.01 parts by mass to 1.0 part by mass, and more preferably 0.1 parts by mass to 0.7 parts by mass.

When a combination of the titanium compound and the tin (II) compound is used, the total amount of the titanium compound and the tin (II) compound present relative to 100 parts by mass of the total amount of the alcohol components and the carboxylic acid components is preferably 0.01 parts by mass to 1.0 part by mass, and more preferably 0.1 parts by mass to 0.7 parts by mass.

The polycondensation of the alcohol components and the carboxylic acid components can be carried out, for example, in the presence of the esterification catalyst, in an inactive gas atmosphere at a temperature of 180° C. to 250° C.

In order to reduce the amount of abietic acid by reduction of the amount of remaining unreacted rosin, steam distillation may be employed as mentioned above.

The form of water introduced into the resin at the time of the steam distillation may be liquid or gas (steam), and the amount of introduced water relative to 100 parts by mass of the obtained resin is, from the viewpoint of controllability of water's influence on resin physical properties, preferably 0.1 parts by mass to 50 parts by mass, more preferably 0.5 parts by mass to 40 parts by mass, and still more preferably 1 part by mass to 30 parts by mass.

From the viewpoints of evaporation efficiency of water and viscosity of the reaction mixture, the temperature at which the resin is mixed with water is preferably 100° C. to 300° C., more preferably 130° C. to 250° C., and still more preferably 150° C. to 240° C. From the viewpoint of shear given a releasing agent, the velocity at which water is added per 100 parts by mass of the resin obtained is preferably 0.002 parts by mass/min to 0.5 parts by mass/min, more preferably 0.008 parts by mass/min to 0.3 parts by mass/min, and still more preferably 0.008 parts by mass/min to 0.2 parts by mass/min.

From the viewpoint of diffusion efficiency of water, the atmospheric pressure under which the resin is mixed with water is preferably 4 kPa to 100 kPa, more preferably 6 kPa to 90 kPa, and still more preferably 20 kPa to 60 kPa. Furthermore, the mixing of the resin with water may be carried out at any time in a period between the time of rosin introduction and the time when, after the completion of the whole reaction, the resin is extracted from the reaction container. However, the resin is preferably in a mixed state with water during a period of the polycondensation reaction or during a period between the time of the start of the polycondensation reaction and the time when, after the completion of the reaction, the resin is extracted from the reaction container.

A method for mixing the resin with water is not particularly limited, may be suitably selected in accordance with the intended use, and is preferably a method of incorporation of steam having a temperature preferably of 100° C. to 260° C., and more preferably of 120° C. to 180° C. into the resin. When a method by which air or nitrogen is incorporated into the resin as bubbles is used and when the viscosity of the resin is high, the size of each bubble becomes large and the bubbles do not interact with the resin, making the effect of the method inadequate. In contrast to this, the method of incorporation of steam into the resin may make it possible to extract the unreacted rosin compound from the resin, because that water is uniformly diffused across a considerable range of the resin as fine steam bubbles which have been blown into the resin.

In the present invention, preferred conditions under which low-temperature fixability, hot-offset resistance, and heat resistant storage stability may be achieved are that a mass ratio [(B)/(A)] of the polyester resin (B) to the polyester resin (A) is 1/9 to 6/4.

The glass transition temperature of the polyester resin (A) and the polyester resin (B) is preferably 45° C. to 75° C., and more preferably 50° C. to 70° C. from the viewpoints of fixability, heat resistant storage stability and durability.

The softening temperature of the polyester resin (B) is preferably 90° C. to 160° C., more preferably 95° C. to 155° C., and still more preferably 100° C. to 150° C., from the viewpoints of fixability, storage stability, and durability.

The acid value of the polyester resin (A) and the polyester resin (B) is preferably 1 mgKOH/g to 70 mgKOH/g. The dispersion state of the resins and releasing agent becomes optimum at the time when the acid value of the polyester resin (A) is in a range of 25 mgKOH/g to 70 mgKOH/g and the acid value of the polyester resin (B) is in a range of 1 mgKOH/g to 25 mgKOH/g.

Note that in the present invention, the term "polyester resin" is a resin having a polyester unit. The polyester unit means a region having a polyester structure, and the polyester resin includes not only polyesters but also includes polyesters which are modified to such an extent that characteristics thereof are not substantially impaired. In the present invention, it is preferably that both of the polyester resins (A) and (B) be a modified polyester. Examples of modified polyesters include, for example, polyesters which are modified with grafts or blocks of phenol, urethane, epoxy or the like by the method described in Japanese Patent Application Laid-Open (JP-A) Nos. 11-133668, 10-239903, 08-20636 and the like, and composite resins having two or more resin units including a polyester unit.

In the present invention, the polyester resin (A) and the polyester resin (B) are preferably amorphous resins differing from crystalline resins. In this specification, an amorphous resin means a resin having a difference in temperature of 30° C. or more between its softening point and its glass transition temperature (Tg).

Note that in the present invention, the binder resin may contain additional resins other than the polyester resin (A) and the polyester resin (B) so long as the effects of the present invention are not impaired.

As the additional resins, in addition to polyester resins, known binder resins, for example, a vinyl resin such as a styrene-acrylic resin, an epoxy resin, polycarbonate, polyurethane, and a composite resin (otherwise referred to as "hybrid resin") having two or more resin units including a polyester unit may be used in combination.

<Releasing Agent>

The releasing agent is not particularly limited, may be suitably selected from those known in accordance with the intended use, and is particularly preferably a wax. Examples of the wax include aliphatic hydrocarbon waxes such as low-molecular-weight polyethylene, low-molecular-weight polypropylene, polyolefin waxes, microcrystalline waxes, paraffin waxes, and SASOLWAX; aliphatic hydrocarbon wax oxides such as polyethylene oxide waxes, or block copolymers thereof; vegetable-derived waxes such as candelilla wax, carnauba wax, rice bran wax, sumac wax, and jojoba wax; animal-derived waxes such as bees wax, lanolin, and whale wax; mineral-derived waxes such as ozocerite, ceresin, and petrolatum; fatty-acid ester-based waxes such as montanic acid ester wax, and castor wax; and partially or completely deoxidized fatty acid esters such as deoxidized carnauba wax.

Examples of the releasing agent further include saturated straight chain fatty acids such as palmitic acid, stearic acid, montanoic acid, and a straight chain alkyl carboxylic acid having a straight chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and a long-chain alkyl alcohol; polyvalent alcohols such as sorbitol; fatty acid amides such as linoleic acid amide, olefinic acid amide, and lauric acid amide; saturated-fatty acid bis-amides such as methylene-bis-capryl-amide, ehthylene-bis-laurylamide, and hexamethylene-bis-stearamide; unsaturated fatty acid amides such as ethylene-bis-oleamide, hexamethylene-bis-oleamide, N,N'-dioleyl-adipic acid-amide, and N,N'-dioleyl-sebacic acid-amide; aromatic his amides such as m-xylene-bis-stearamide, and N,N'-distearyl-isophthalic acid-amide; metal salts of fatty acids such as calcium stearate, calcium laurate, zinc stearate, and magnesium stearate; waxes produced by combining an aliphatic hydrocarbon wax with a graft of a vinyl monomer such as styrene and acrylic acid; partial esterification compounds obtained by reaction of a fatty acid such as a monoglyceride of behenic acid with a polyvalent alcohol; and methyl ester compounds having a hydroxyl group obtained by hydrogenation of vegetable oil and fat.

Examples of the releasing agent further include polyolefins obtained by radical polymerization of an olefin under high pressure; polyolefins obtained from purification of low-molecular-weight by-products produced by polymerization of high-molecular weight polyolefins; polyolefins produced by polymerization under low pressure in the presence of such a catalyst as a Ziegler catalyst and a metallocene catalyst; polyolefins produced by polymerization by radiation, electromagnetic waves, or light; low-molecular-weight polyolefins produced by thermal decomposition of high-molecular weight polyolefins; paraffin waxes; microcrystalline waxes; Fischer-Tropsch waxes; synthetic hydrocarbon waxes synthesized by Synthol process, Hydrocol process, Arge process, or the like; synthetic waxes containing a compound of one carbon atom as a monomer; hydrocarbon waxes having a functional group such as a hydroxyl group and a carboxyl group; a mixture of a hydrocarbon wax and a hydrocarbon wax having a functional group; and waxes wherein the above waxes as base materials are modified with a graft of a vinyl monomer such as styrene, maleic acid ester, acrylate, methacrylate and maleic anhydride.

Furthermore, it is preferable to use these releasing agents of which molecular weight distribution is sharpened by treating them with Press sweating process (method), solvents, recrystallization method, vacuum distillation method, supercritical gas extraction method or solution crystallization method; or waxes from which low-molecular-weight solid fatty acids, low-molecular-weight solid alcohols, low-molecular-weight solid compounds or other impurities are removed.

Especially in the case of toners produced by pulverization, a releasing agent becomes exposed on newly developed toner surfaces which are formed by cracking of the pre-toners caused by the pulverization likely at the interface between binder resins and the releasing agent where the cracking are easy to occur, causing filming on a photoconductor or a carrier. However, the binder resins of the present invention achieve distinctly excellent dispersibility of a releasing agent and are compatible with the releasing agent, making it difficult for the releasing agent to leave from the toner. Therefore, the toner causes the filming less frequently than the conventional toners do. Among the above-mentioned releasing agents, carnauba wax and rice bran wax, which achieve the most suitable dispersibility of binder resins, are still more preferable for use in combination with the binder resins used in the present invention. Among the carnauba waxes, those from which free fatty acids have been removed are particularly preferable.

The releasing agent preferably has a melting temperature of 60° C. to 120° C. and more preferably 70° C. to 110° C. in order to balance fixability and offset resistance. When the melting temperature is lower than 60° C., the blocking resistance may be degraded. When the melting temperature is higher than 120° C., the hot-offset resistance may be difficult to achieve.

Furthermore, combined use of two or more different types of releasing agents may achieve both plasticizing effect and releasing effect, each of which is an effect realized by a type of releasing agents.

Examples of releasing agents having the plasticizing effect are releasing agents having a low melting temperature, those having a branched molecular structure, and those having a polar group in the structure. Examples of releasing agents having the releasing effects are releasing agents having a high melting temperature, those having a straight molecular structure, and those having nonpolar molecules which do not have any functional group. As examples of use thereof, there are a combination of two or more types of releasing agents between which the difference of the melting temperatures is 10° C. to 100° C.; and a combination of a polyolefin and a polyolefin modified with a graft.

When selecting two types of releasing agents, in the case of releasing agents having a similar structure, a releasing agent which has a relatively lower melting temperature exerts the plasticizing effect, and a releasing agent which has a relatively higher melting temperature exerts the releasing effect. At that time, when the difference of each melting temperatures is 10° C. to 100° C., the two releasing agents are functionally separated effectively. When the difference is less than 10° C., it may be difficult to functionally separate the two releasing agents effectively, and when it is more than 100° C., it may be difficult to synergistically enhance each function by the interaction. In such a case, at least one of the releasing agents preferably has a melting temperature of 60° C. to 120° C. and more preferably 70° C. to 110° C., because attainment of the effective functional separation tends to become easy.

The releasing agent which has a relatively branched molecular structure, has a relatively polar group such as a functional group, or is relatively modified with a component different from the main component achieves the plasticizing effect. In contrast, the releasing agent which has a relatively straight molecular structure, is relatively nonpolar molecules which do not have any functional group, or is relatively unmodified and straight achieves the releasing effect. Examples of preferable combination thereof include a combination of a polyethylene homopolymer or copolymer having ethylene as the main component and a polyolefin homopolymer or copolymer having an olefin other than ethylene as the main component; a combination of a polyolefin and a polyolefin modified with a graft; a combination of a hydrocarbon wax, and an alcohol wax, a fatty acid wax or an ester wax; a combination of a Fischer-Tropsch wax or a polyolefin wax, and a paraffin wax or a microcrystalline wax; a combination of a Fischer-Tropsch wax and a polyolefin wax; a combination of a paraffin wax and a microcrystalline wax; and a combination of a hydrocarbon wax, and a carnauba wax, a candelilla wax, a rice bran wax or a montan wax.

In every case, it is preferable that the peak-top temperature of the maximum peak, recognized as an endothermic peak observed in the DSC measurement of the toner, is within 60° C. to 120° C. for easy attainment of the toner storage stability and fixability in a balanced manner. It is more preferable that the maximum peak is within 70° C. to 110° C. In the present invention, the melting temperature of a releasing agent is defined as the peak-top temperature of the maximum peak recognized as an endothermic peak of the releasing agent (wax) observed by DSC.

Here, the peak-top temperature is determined based on a DSC curve obtained using as a DSC measurement device for the releasing agent or toner a differential scanning calorimeter (TA-60WS and DSC-60, manufactured by Shimadzu Corporation). The measurement method is in accordance with ASTM D3418-82. The DSC curve used in the present invention is the curve measured when a sample is heated at a temperature increase rate of 10° C./min after heating and cooling the sample once and taking a record in advance.

The amount of the releasing agent in the toner is not particularly limited, and may be suitably selected in accordance with the intended use. A preferable dispersion state is obtained when a mixing rate of the releasing agent to 100 parts by mass of the binder resin is 0.2 parts by mass to 30 parts by mass, more preferably 1 part by mass to 20 parts by mass, and still more preferably 3 parts by mass to 15 parts by mass.

<Colorant>

The colorant used in the present invention is not particularly limited and may be suitably selected from among known dyes and pigments in accordance with the intended use. Examples of the colorant include carbon black; Nigrosine dyes, black iron oxide, Naphthol Yellow S, Hansa Yellow (10G, 5G, and G), Cadmium Yellow, yellow iron oxide, loess, chrome yellow, Titan Yellow, polyazo yellow, Oil Yellow, Hansa Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, and lithopone. These colorants may be used alone or in combination.

Color of the colorant is not particularly limited and may be suitably selected in accordance with the intended use. For example, colorants for black toner, and colorants for color toner are exemplified. These colorants may be used alone or in combination.

Examples of colorants for black toner include carbon blacks (C.I. Pigment Black 7) such as furnace black, lamp black, acetylene black, and channel black; metals such as copper and iron (C.I. Pigment Black 11), and titanium oxides; and organic pigments such as aniline black (C.I. Pigment Black 1).

Examples of colorants for magenta color pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; and C.I. Pigment Violet 19; C.I. Vat Red 1, 2, 10, 13, 15, 23, 29, and 35.

Examples of colorants for cyan color pigment include C.I. Pigment Blue 2, 3, 15, 15:1, 15:2, 15:3, 15:4, 15:6, 16, 17, and 60; C.I. Vat Blue 6; C.I. Acid Blue 45 or copper-phthalocyanine pigment whose phthalocyanine skeleton has been substituted with 1 to 5 phthalimide methyl groups, Green 7, and Green 36.

Examples of colorants for yellow color pigment include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 3, and 20, and Orange 36.

The amount of the colorant contained in the toner is not particularly limited and may be suitably selected in accordance with the intended use. It is preferably 1% by mass to 15% by mass, and more preferably 3% by mass to 10% by mass. When the amount of the colorant is less than 1% by mass, reduction of tinting strength of the toner is observed, and when it is more than 15% by mass, dispersion defect of the pigment occurs in the toner is observed, possibly leading to degradation of tinting strength, and degradation of electric properties of the toner.

The colorant may be combined with a resin for use as a masterbatch. The resin is not particularly limited and may be suitably selected from among known resins in accordance with the intended use. Examples of the resin include styrenes or polymers of the substitution product thereof, styrene copolymers, polymethylmethacrylate resins, polybutylmethacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylate resins, rosins, modified rosins, terpene resins, aliphatic hydrocarbon resins, alicyclic hydrocarbon resins, aromatic petroleum resins, chlorinated paraffins, and paraffins. These may be used alone or in combination.

Examples of the styrenes or polymers of the substitution product thereof include polyester resins, polystyrene, poly(p-chlorostyrene) resins and polyvinyltoluene resins. Examples of styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl-α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers.

The masterbatch can be obtained by mixing and kneading the resin for masterbatch and the colorant under application of high shearing force. On that occasion, it is preferable to add an organic solvent to a mixture of the colorant and the resin so as to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

<Charge Control Agent>

The charge control agent is not particularly limited and may be suitably selected from known charge control agents in accordance with the intended use. When a colored material is used for a charge control agent, the resulting toner may change in color. Thus, a colorless material and/or material of color close to white is preferably used. Examples of the charge control agent include, triphenylmethane dyes, molybdic acid chelate pigments, rhodamine dyes, alkoxy-based amines, quaternary ammonium salts (including fluorine-modified quaternary ammonium salt), alkylamides, a single substance of phosphorus or compound thereof, a single substance of tungsten or compound thereof, fluorochemical surfactants, salicylic acid metal salts, and metal salts of salicylic acid derivatives. These may be used alone of in combination.

For the charge control agent, commercially available products may be used. Specific examples of the commercially available products include BONTRON P-51 of a quaternary ammonium salt, E-82 of an oxynaphthoic acid-based metal complex, E-84 of a salicylic acid-based metal complex, and E-89 of a phenolic condensate (produced by ORIENT CHEMICAL Co. Ltd.); TP-302 and TP-415 of a quaternary ammonium salt molybdenum complex (produced by HODOGAYA CHEMICAL Co., Ltd.); COPY CHARGE PSY VP2038 of a quaternary ammonium salt, COPY BLUE PR of a triphenyl methane derivative, COPY CHARGE NEG VP2036 of a quaternary ammonium salt, and COPY CHARGE NX VP434 (produced by Hoechst AG); LRA-901 and LR-147 of a boron complex (produced by NIPPON CARLIT Co., Ltd.); quinacridone, azo pigments, and other polymer compounds having a functional group such as sulfonic group, carboxyl group, quaternary ammonium salt or the like.

The charge control agent may be melt-kneaded together with the masterbatch before being dissolved and/or dispersed, or may be directly added along with respective components of the toner to the organic solvent when the components are dissolved and/or dispersed therein, or may be fixed on a surface of toner after toner particles are produced.

The amount of the charge control agent contained in the toner differs depending on the type of the binder resin used, presence or absence of additives, and a dispersion method employed, and is not unequivocally defined. However, for example, it is preferably 0.1 parts by mass to 10 parts by mass, and more preferably 0.2 parts by mass to 5 parts by mass, to 100 parts by mass of the binder resin. When the amount of the charge control agent is less than 0.1 parts by mass, sufficient charge controlling property may not be obtained. When it is more than 10 parts by mass, the effect of the primary charge control agent is impaired due to excessively high chargeability of the toner to increase the electrostatic attraction force to a developing roller, possibly leading to degradation in flowability of the developer and degradation in image density.

—External Additive—

The external additive is not particularly limited and may be suitably selected from among known additives in accordance with the intended use. Preferred examples thereof include silica fine particles, hydrophobized silica, fatty acid metal salts (e.g. zinc stearate, aluminum stearate); metal oxides (e.g. titania, alumina, tin oxide, antimony oxide); and fluoropolymers. Among these, there may be exemplified a hydrophobized silica fine particle, a hydrophobized titania fine particle, a hydrophobized titanium oxide fine particle, and a hydrophobized alumina fine particle.

Specific examples of the silica fine particle include HDK H 2000, HDK H 2000/4, HDK H 2050EP, HVK21, and HDK H1303 (all produced by Hoechst AG); R972, R974, RX200, RY200, R202, R805, and R812 (all produced by Japan AEROSIL Inc.). Specific examples of the titania fine particle include P-25 (produced by Japan AEROSIL Inc.), STT-30 and STT-65C-S (produced by Titan Kogyo Ltd.), TAF-140 (produced by Fuji Titanium Industry Co., Ltd.), MT-150W, MT-500B, MT-600B, and MT-150A (all produced by TAYCA CORPORATION). Examples of the hydrophobized titan oxide include T-805 (produced by Japan AEROSIL Inc.); STT-30A and STT-65S-S (produced by Titan Kogyo Ltd.); TAF-500T and TAF-1500T (produced by Fuji titanium Industry Co., Ltd.); MT-100S and MT-100T (produced by TAYCA CORPORATION); and IT-S (Ishihara Sangyo Kaisha Ltd.).

The hydrophobized oxide fine particle, hydrophobized silica fine particle, hydrophobized titania fine particle, and hydrophobized alumina fine particle can be obtained by surface treating a hydrophilic fine particle with a silane coupling agent such as methyl trimethoxy silane, methyl triethoxy silane, octyl trimethoxy silane or the like. Also, a silicone oil-treated oxide fine particle or silicone oil-treated inorganic fine particle obtained by surface treating an inorganic fine particle with silicone oil under application of heat as necessary are favorably used.

As the silicone oil, for example, dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy polyether-modified silicone oil, phenol-modified silicone oil, carboxyl-modified silicone oil, mercapto-modified silicone oil, acrylic or methacrylic-modified silicone oil, and α-methylstyrene-modified silicone oil and the like can be used.

Specific examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride. Among these, silica and titanium dioxide are particularly preferable.

The amount of the external additive added to the toner is preferably 0.1% by mass to 5% by mass, and more preferably 0.3% by mass to 3% by mass.

The average primary particle diameter of the inorganic fine particle is preferably 100 nm or less, and more preferably 3 nm to 70 nm. When the average primary particle diameter of the inorganic fine particle is smaller than the range described above, the inorganic fine particle is embedded in the toner, and the function thereof is hardly effectively exerted. When it is larger than the range, unfavorably, the inorganic fine particle uniformly damages a surface of a latent electrostatic image bearing member. As the external additive, an inorganic fine particle can be used in combination with a hydrophobized inorganic fine particle, and the average primary particle diameter of the hydrophobized inorganic fine particle is preferably 1 nm to 100 nm. In particular, the external additive preferably contains at least two types of hydrophobized inorganic fine particles having an average primary particle diameter of 5 nm to 70 nm. Still more preferably, the external additive contains at least two types of hydrophobized inorganic fine particles having an average primary particle diameter of 20 nm or smaller and at least one hydrophobized inorganic fine particle having an average primary particle diameter of 30 nm or larger. Also, it is preferable that the specific surface area of the inorganic fine particles measured by BET method be 20 $m^2/g$ to 500 $m^2/g$.

Examples of a surface treatment agent of the external additive containing the oxide fine particles include silane coupling agents, such as dialkyl dihalogenated silane, trialkyl halogenated silane, alkyl trihalogenated silane, and hexaalkyl disilazane; silylation agents, silane coupling agents having a fluorinated alkyl group, organic titanate coupling agents, aluminum coupling agents, silicone oils, and silicone varnishes.

A resin fine particle can also be added as the external additive. Examples of the resin fine particle include polystyrene obtained by soap-free emulsification polymerization, suspension polymerization or dispersion polymerization; copolymers of methacrylic acid ester and acrylic acid ester; polycondensation fine particles such as silicones, benzoguanamine, and nylon; and polymer particles of thermosetting resins. By using such resin fine particle in combination with inorganic fine particles, it is possible to strengthen the chargeability of the toner, to reduce the amount of oppositely charged toner and to reduce the occurrence of background smear. The amount of the resin fine particle added is preferably 0.01% by mass to 5% by mass, and more preferably 0.1% by mass to 2% by mass to the toner.

<Additional Components>

The additional components are not particularly limited and may be suitably selected in accordance with the intended use. Examples thereof include, a flowability improver, a cleaning property enhancer, a magnetic material, and a metal soap.

The flowability improver increases hydrophobicity by surface treatment, can prevent degradation of flow characteristics or charging characteristics even at a high humidity, and includes, for example, a silane coupling agent, a silylation agent, a silane coupling agent having a fluorinated alkyl group, an organic titanate-based coupling agent, an aluminum-based coupling agent, a silicone oil, a modified silicone oil, and so forth.

The cleanability improver is added to the toner in order to remove an untransferred developer, remaining on a latent electrostatic image bearing member and an intermediate transfer member, and examples thereof include, fatty acid metal salts such as zinc stearate, calcium stearate, and stearic acid; and polymer fine particles produced by soap-free emulsification polymerization, such as a polymethyl methacrylate fine particle and a polystyrene fine particle. As the polymer fine particle, a polymer fine particle having a relatively narrow particle size distribution and a mass average particle diameter of 0.01 μm to 1 μm is preferably used.

The magnetic material is not particularly limited and may be suitably selected from among known magnetic materials in accordance with the intended use. Examples thereof include, iron powder, magnetite, and ferrite. Among these, white color materials are preferably used from the viewpoint of color tone.

<Method for Producing Toner>

The method for producing a toner of the present invention is not particularly limited and hitherto known methods such as kneading/pulverizing method, polymerization method, dissolution suspension method, spray granulation method can be employed, however, from the viewpoint of productivity, the kneading/pulverizing method is preferably employed for efficiently achieving the effects of the present invention.

The kneading/pulverization method is, for example, a method of melt-kneading toner materials containing at least a binder resin, a releasing agent, and a colorant, and pulverizing and classifying the kneaded product thus obtained, to produce toner base particles of the toner.

In the melt-kneading, the toner materials are mixed, and the mixture is put into a melting kneader to be melt-kneaded. The melting kneader may be one-shaft or two-shaft continuous kneaders or batch kneaders with roll mills. Preferable examples thereof include KTK type two-shaft extruder (by Kobe Steel, Ltd.), TEM type extruder (by Toshiba Machine Co.), two-shaft extruder (by KCK Co.), PCM type two-shaft extruder (by Ikegai Ltd.), and Co-kneader (by Buss Co.). It is preferable that the melt-kneading step is carried out under appropriate conditions in which molecular chains of binder resins are not cut. Specifically, the melt-kneading temperature is adjusted in consideration of the softening point of the binder resin. When the temperature is excessively higher than the softening point, molecular chains of binder resins are severely cut. When the temperature is excessively low, toner materials may not be sufficiently dispersed.

In the pulverizing, the kneaded product obtained from the kneading step is pulverized. In the pulverizing, preferably the kneaded product is coarsely pulverized then finely pulverized. Examples of preferred pulverizing methods include a method of making the materials collide with a plate by means of jet air, a method of making particles collide each other by means of jet air, and a method of pulverizing by use of a narrow gap between mechanically rotating rotors and stators.

In the classifying, the pulverized product obtained from the pulverizing is classified so as to obtain particles of a predetermined particle diameter. The classifying may be carried out by removing a part of the particles that are finer than a desired size with, for example, a cyclone, a decanter, or a centrifuge.

After the pulverizing and classifying, the pulverized product is classified in an air flow by use of centrifugal force, to thereby produce toner base particles having a predetermined particle diameter.

Next, external additives are externally added to the toner base particle. While being broken and pulverized, the external additives are applied to a surface of the toner base particles by mixing and stirring the toner base particles and the external additives using a mixer. In this process, it is important to attach uniformly and tightly the external additives such as fine inorganic particles and fine resin particles to the toner base particles, in terms of enhancement of durability.

The mass average particle diameter of the toner is not particularly limited and may be suitably adjusted in accordance with the intended use. Here, the mass average particle diameter of the toner can be determined in accordance with the following manner.

Measurement device: COULTER MULTISIZER II (manufactured by Beckman Coulter Co.)

Aperture diameter: 100 μm

Analyzing software: COULTER MULTISIZER ACCUCOMP VER. 1.19 (manufactured by Beckman Coulter Co.)

Electrolytic solution: "Isotone II" (manufactured by Beckman Coulter Co.)

Dispersion liquid: A 5% electrolytic solution of "EMULGEN 109P" (manufactured by Kao Corporation, polyoxyethylene lauryl ether, HLB: 13.6)

Dispersion Conditions: 10 mg of a test sample is added to 5 ml of the dispersion liquid, and the resulting mixture is dispersed in an ultrasonic dispersing device for 1 minute. Thereafter, 25 ml of the electrolytic solution is added to the dispersion liquid, and the resulting mixture is dispersed in the ultrasonic dispersing device for another 1 minute.

Measurement Conditions: 100 ml of the electrolytic solution and the dispersion liquid are added to a beaker, and the particle sizes of 30,000 particles are determined under the conditions for concentration satisfying that the determination for 30,000 particles are completed in 20 seconds. The mass average particle diameter is obtained from the particle size distribution.

(Developer)

The toner of the present invention may be used as a developer which contains at least the toner and suitably selected additional components such as a carrier. The developer may be a one-component developer or two-component developer. When the developer is used in a super-high-speed printing system which can be used in recent POD technology, it is preferable to use the two-component developer from the viewpoint of improvement of operation life.

The carrier is not particularly limited and may be suitably selected in accordance with the intended use, however, the carrier preferably includes a core material and a resin layer for coating the core material.

A material of the core material is not particularly limited and may be suitably selected from hitherto known materials. Preferred examples thereof include a manganese-strontium (Mn—Sr) based material and a manganese-magnesium (Mn—Mg) based material in a range of 50 emu/g to 90 emu/g. From the viewpoint of ensuring the image density, a highly magnetized material such as iron powder (100 emu/g or more) and magnetite (75 emu/g to 120 emu/g) is preferable. Moreover, a weakly magnetized material such as a copper-zinc (Cu—Zn) based material (30 emu/g to 80 emu/g) is preferable since the weakly magnetized material is capable of weakening a contact with a latent electrostatic image bearing member on which the toner is erected (forming a brush) and advantageous in achieving a high image quality. These may be used alone or in combination.

As a particle diameter of the core material, the average particle diameter (mass average particle diameter (D50)) is preferably 10 μm to 200 μm, and more preferably 40 μm to 100 μm. When the average particle diameter (mass average particle diameter (D50)) is less than 10 in a distribution of carrier particles, fine particles are increased and a magnetization per particle becomes low, thereby causing scattering of the carrier. When the average particle diameter (mass average particle diameter (D50)) is more than 200 μm, a specific surface area is decreased, and toner scattering may occur. In a full color having a substantial solid portion, reproducibility of the solid portion in particular may degrade.

A material of the resin layer is not particularly limited, and may be suitably selected from among hitherto known resins in accordance with the intended use. Examples of the material of the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers (fluorinated tri-(multi-) copolymers) such as terpolymers of tetrafluoroethylene with vinylidene fluoride with non-fluoride monomer, silicon resins, and the like. These may be used alone or in combination. Among these, silicone resins are particularly preferable.

The silicone resin is not particularly limited and may be suitably selected from among generally known silicone resins in accordance with the intended use. Examples of the silicone resins include straight silicone resins having only organosiloxane bonding; and silicone resins which are modified with alkyd resin, polyester resin, epoxy resin, acrylic resin, urethane resin and the like.

As the silicone resins, commercially available products can be used. Examples of commercially available straight silicone resins include KR271, KR255 and KR152 (produced by Shin-Etsu Chemical Co., Ltd.); and SR2400, SR2406 and SR2410 (produced by TORAY Dow Corning Silicone Co., Ltd.).

As the modified silicone resins, commercially available products can be used. Examples of commercially available modified silicone resins include KR206 (alkyd-modified), KR5208 (acryl-modified), ES1001N (epoxy-modified), KR305 (urethane-modified) produced by Shin-Etsu Chemical Co., Ltd.; and SR2115 (epoxy-modified) and SR2110 (alkyd-modified) produced by TORAY Dow Corning Silicone Co., Ltd.

Note that a silicone resin can also be used as a single substance, or a crosslinkable component, a charge controlling component may also be used together.

The resin layer may contain a conductive powder and the like in accordance with the necessity. Examples of the conductive powder include metal powders, carbon blacks, titanium oxides, tin oxides and zinc oxides. An average particle diameter of these conductive powders is preferably 1 μm or smaller. When the average particle diameter is larger than 1 μm, it may become difficult to control the electric resistance.

The resin layer can be formed, for example, by the following method. The silicone resin and the like are dissolved in a solvent to prepare a coating solution liquid, the solution liquid is applied uniformly to the surface of the core material by a known coating method, followed by drying and baking, thereby a resin layer can be formed. As the coating method, for example, dip-coating method, spray-coating method, brush-coating method are exemplified.

The solvent is not particularly limited and may be suitably selected in accordance with the intended use. Examples thereof include toluene, xylylene, methyl ethyl ketone, methyl isobutyl ketone, cellosolve, and butyl acetate.

The baking is not particularly limited and may be externally heating or internally heating. For example, a method of using a fixed type electric furnace, a fluid type electric furnace, a rotary type electric furnace or a burner furnace; a method of using a microwave are exemplified.

The amount of the resin layer in the carrier is preferably 0.01% by mass to 5.0% by mass. When the amount of the resin layer is less than 0.01% by mass, the resin layer may not be formed uniformly on a surface of the core material, and when it is more than 5.0% by mass, carrier particles are agglomerated each other because of excessively thickened resin layer, and uniform carrier particles may not be obtained.

When the developer is a two-component developer, the amount of the carrier contained in the two-component developer is not particularly limited and may be suitably adjusted in accordance with the intended use, for example, it is preferably 90% by mass to 98% by mass, and more preferably 93% by mass to 97% by mass.

The mixing ratio of the toner and the carrier in the two-component developer is preferably 1 part by mass to 10.0 parts by mass relative to 100 parts by mass of carrier.

The toner and the developer of the present invention are capable of achieving low-temperature fixability, offset resistance, and heat resistant storage stability, can also reduce the occurrence of odor, further have remarkable effect of improving smear resistance on developing roller and the like, and excellent in productivity, where the level of the capability of achieving low-temperature fixability, offset resistance, and heat resistant storage ability is such that the capability may be used in super-high-speed image forming systems. Therefore the toner and the developer of the present invention are suitable for use in a super-high-speed printing system which can be used in electrophotographic print-on-demand technology.

EXAMPLES

Hereinafter, Examples of the present invention will be described, which however shall not be construed as limiting the scope of the present invention.

In Examples and Comparative Examples described below, "softening point of resin", "softening point of rosin", "glass transition temperature (Tg) of resin and rosin", "acid values of resin and rosin", "contained amount of low-molecular-weight component having a molecular weight of 500 or less", "mass average particle diameter and particle size distribution ($D_4$/Dn) of toner", and "amount of abietic acid in rosin or toner" were measured in accordance with the following methods.

<Measurement of Softening Point of Resin>

Using Flow Tester (manufactured by Shimadzu Corporation, CFT-500D), 1 g of each resin as a sample was extruded through a nozzle having a diameter of 1 mm and a length of 1 mm by applying a load of 1.96 MPa from a plunger while heating at a temperature raising rate of 6° C./min. A fall amount of the plunger in Flow Tester to the temperature was plotted, and the temperature at which a half amount of the sample was flowed out was taken as a softening point.

<Measurement of Softening Point of Rosin>

(1) Preparation of Sample

A rosin (10 g) was melted on a hot plate at 170° C. for 2 hours. In an opening state, the rosin was naturally cooled under an environment of a temperature of 25° C. and a relative humidity of 50% for one hour and then ground by a coffee mill (National MK-61M) for 10 seconds to obtain a sample.

(2) Measurement

Using Flow Tester (manufactured by Shimadzu Corporation, CFT-500D), 1 g of a sample was extruded through a nozzle having a diameter of 1 mm and a length of 1 mm by applying a load of 1.96 MPa from a plunger while heating at a temperature raising rate of 6° C./min. A fall amount of the plunger in Flow Tester to the temperature was plotted and the temperature at which a half amount of the sample was flowed out was taken as a softening point.

<Measurement of Glass Transition Temperature (Tg) of Resin>

Using a differential scanning calorimeter (manufactured by Seiko Electronic Industry Co., Ltd., DSC210), each sample was weighed in an amount of 0.01 g to 0.02 g in an aluminum pan. After heating to 200° C., the sample cooled from the same temperature to 0° C. at a temperature falling rate of 10° C./min was heated at a temperature raising rate of 10° C./min, and then the temperature at an intersection point of an extension line of a base line in a region of a temperature immediately below an endothermic maximum peak temperature and a tangent line showing a maximum slope from a peak rising region to a peak top was taken as a glass transition temperature.

<Acid Value of Resin and Rosin>

According to the method defined in JIS K0070, an acid value was measured, except that for a measurement solvent, a mixed solvent of ethanol and ether defined in JIS K0070 was replaced by a mixed solvent of acetone and toluene (acetone: toluene=1:1 (volume ratio)).

<Contained Amount of Low-Molecular-Weight Component Having Molecular Weight of 500 or Less>

Molecular weight distribution was measured by gel permeation chromatography (GPC). First, to 30 mg of each polyester-based binder resin, 10 ml of tetrahydrofuran was added and, after mixing using a ball mill for one hour, insoluble components were removed by filtering through a fluororesin filter having a pore size of 2 μm "FP-200" (manufactured by Sumitomo Electric Industries, Ltd.) to prepare a sample solution.

Tetrahydrofuran as an eluate was allowed to flow at a flow rate of 1 ml per minute and a column was stabilized in a thermostatic bath at 40° C., and after injecting 100 μL of the sample solution, the measurement was performed. "GMHLX+G3000HXL" (manufactured by TOSOH CORPORATION) was used as an analytic column and a calibration curve for a molecular weight was made using several kinds of monodisperse polystyrenes ($2.63\times10^3$, $2.06\times10^4$, and $1.02\times10^5$ produced by TOSOH CORPORATION, and $2.10\times10^3$, $7.00\times10^3$ and $5.04\times10^4$ produced by GL Sciences Inc.) as a standard sample.

Next, the contained amount (%) of a low-molecular-weight component having a molecular weight of 500 or less was calculated as the proportion of an area of the corresponding region in a chart area obtained with an RI (refractive index) detector.

<Mass Average Particle Diameter and Particle Size Distribution of Toner>

The mass average particle diameter and particle size distribution of toner was measured using a particle size measuring device ("MULTISIZER III", manufactured by Beckman Coulter Inc.) with an aperture diameter of 100 μm, and the measurement data was analyzed using analysis software (BECKMAN COULTER MULTISIZER 3 Ver. 3.51). Specifically, in a 100 mL glass beaker, 0.5 mL of 10% by mass of a surfactant (alkylbenzene sulfonate, NEOGEN SC-A, manufactured by DAI-ICHI KOGYO SEIYAKU CO., LTD.) and 0.5 g of each toner were added and mixed using a micro spatula. Next, 80 mL of ion exchange water was added thereto. The obtained dispersion liquid was dispersed in an ultrasonic dispersion device (W-113MK-II, manufactured by HONDA ELECTRONICS) for 10 minutes. Measurement of mass average particle diameter was carried out for the dispersion liquid using the MULTISIZER III and using ISOTON III (manufactured by Beckman Coulter Inc.) as a measurement solution. In the measurement, the toner sample dispersion liquid was delivered by drops such that the concentration indicated by the device was 8% by mass±2% by mass. In this measurement method, it is important to control the concentration within the range of 8% by mass±2% by mass, from the viewpoint of measurement reproducibility of particle diameter. Within this concentration range, it is possible to reduce measurement errors of particle diameter as small as possible.

For channels used in the measurement, the following 13 channels were used: 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm. Thus, particles having a particle diameter of 2.00 μm or more and less than 40.30 μm were intended for the measurement.

After measuring the mass and number of each toner, a mass distribution and number distribution were calculated. The mass average particle diameter and particle size distribution of each toner was determined based on the mass distribution and number distribution thus obtained.

<Amount of Abietic Acid in Rosin or in Toner>

A sample was dissolved in acetone to prepare a 0.3% by mass solution, and the solution was methyl-esterified with diazomethane, and subsequently the esterified product was analyzed by GC (gas chromatography equipment: HP6890, manufactured by Agilent Co.) under the following measurement conditions:

Analytic column: HP-5 (30 m-250 μm-0.25 μm)
Carrier: helium
Flow conditions: 1 mL/min
Injection inlet temperature: 250° C.
Column head pressure: 126.8 kPa
Injection mode: split
Split ratio: 30:1
Oven temperature conditions: 180° C. (5 min)-2° C./min (temperature increase rate) to 200° C.-200° C. (5 min)

Synthesis Example A

Synthesis of Fumaric Acid-Modified Rosin

Into a 10 L volumetric flask equipped with a fractional distillation tube, a reflux condenser tube and a receiver, 5,312 g (16 mol) of an unpurified tall rosin and 928 g (8 mol) of fumaric acid were loaded, and the temperature of the mixture was increased from 160° C. to 210° C. in a 2-hour period, then the mixture was reacted at 210° C. for 3 hours, and subsequently distilled at 210° C. under reduced pressure of 4 kPa to synthesize a modified rosin with fumaric acid (fumaric acid-modified rosin). The amount of abietic acid in the fumaric acid-modified rosin thus obtained was 2.8% by mass.

Synthesis Examples 1 to 4

Synthesis of Polyester Resins A1 to A4

An alcohol component, a carboxylic acid component other than trimellitic anhydride, and an esterification catalyst shown in Table 1 were loaded into a 5 liter volumetric four-necked flask equipped with a nitrogen inlet tube, a dewatering tube, a stirrer and a thermocouple, and the polycondensation reaction was carried out under a nitrogen atmosphere at 235° C. for 15 hours, and then the polycondensation reaction was carried out at 235° C. at 8.0 kPa for one hour. After cooling to 210° C., trimellitic anhydride as shown in Table 1 was added, and reaction was continued at 210° C. under a normal pressure (101.3 kPa) for one hour, and the reaction was carried out at 210° C. at 10 kPa until a desired softening point was reached to synthesize the polyester resins A1 to A4.

Synthesis Example 5

Synthesis of Polyester Resins A5

An alcohol component, a carboxylic acid component other than trimellitic anhydride (for an unpurified tall rosin, the unpurified tall rosin used in the production of the fumaric acid-modified rosin was used), and an esterification catalyst shown in Table 1 were loaded into a 5 liter volumetric four-necked flask equipped with a nitrogen inlet tube, a dewatering tube, a rectifying column, a stirrer, and a thermocouple, and the polycondensation reaction was carried out under a nitrogen atmosphere at 235° C. for 10 hours, and then the polycondensation reaction was carried out at 235° C. at 8.0 kPa for 2 hours. After cooling to 210° C., trimellitic anhydride as shown in Table 1 was added, and the reaction was continued at 210° C. under a normal pressure (101.3 kPa) for 2 hours, and, while dripping steam of 140° C. at a rate of 5 g/min (steam distillation) the reaction was carried out at 210° C. at 20 kPa until a desired softening point was reached to synthesize the polyester resin A5. Note that the addition rate of steam (5 g/min) corresponded to a rate of 0.11 parts by mass/min of steam to 100 parts by mass of the polyester resin thus obtained, and the total amount of dripped water was 896 g, i.e. 20 parts by mass per 100 parts by mass of the binder resin.

TABLE 1

| | | Synthesis Examples | | | | |
|---|---|---|---|---|---|---|
| | | 1 | 2 | 3 | 4 | 5 |
| | Polyester resin No. | A1 | A2 | A3 | A4 | A5 |
| Alcohol component | 1,2-propanediol | 1,142 g | 1,142 g | 1,142 g | 914 g | 1,142 g |
| | 1,3-propanediol | — | — | — | 228 g | — |
| Carboxylic acid component | terephthalic acid | 1,743 g | 2,409 g | 2,132 g | 1,743 g | 1,743 g |
| | trimellitic anhydride | 288 g | 288 g | 288 g | 288 g | 288 g |
| | unpurified rosin | — | — | — | — | 1,743 g |
| | Fumaric acid-modified rosin | 1,743 g | 184 g | 110 g | 1,743 g | — |
| Esterification catalyst | tin (II) 2-ethylhexanoate[1)] | 24.6 g (0.5) | 18.4 g (0.5) | 18.4 g (0.5) | 24.6 g (0.5) | 24.6 g (0.5) |
| Amount of aliphatic diol in divalent alcohol component (mole %) | | 100 | 100 | 100 | 100 | 100 |
| Amount of 1,2-propanediol in aliphatic diol (mole %) | | 100 | 100 | 100 | 80 | 100 |
| Amount of rosin compound (% by mass)[2)] | | 35 | 5 | 3 | 35 | 35 |
| Physical properties of polyester resin | Acid value (mgKOH/g) | 32.7 | 31.1 | 31.5 | 30.9 | 30.1 |
| | Softening temperature (° C.) | 105.8 | 103.0 | 102.8 | 105.0 | 104.8 |
| | Glass transition temperature (° C.) | 57.3 | 58.2 | 57.1 | 58.5 | 56.8 |
| | Amount of low-molecular-weight component having molecular weight of 500 or less (%) | 5.0 | 7.2 | 8.6 | 8.0 | 12.6 |

[1)]Molar concentration of tin (II) 2-ethylhexanoate in parenthesis.

[2)]Amount of rosin compound (% by mass) in the total mass of alcohol component and carboxylic acid component.

Unpurified rosin: the unpurified tall rosin used in production of fumaric acid-modified rosin.

Synthesis Examples 6 to 12

Synthesis of Polyester Resins B1 to B7

An alcohol component, a carboxylic acid component other than trimellitic anhydride, and an esterification catalyst shown in Table 2 were loaded into a 5 liter volumetric four-necked flask equipped with a nitrogen inlet tube, a dewatering tube, a stirrer and a thermocouple, and the polycondensation reaction was carried out under a nitrogen atmosphere at 230° C. for 10 hours, and then the polycondensation reaction was carried out at 230° C. under 8 kPa for one hour. After cooling to 220° C., trimellitic anhydride shown in Table 2 was added, followed by reaction under a normal pressure (101.3 kPa) for one hour, and then the reaction was carried out at 220° C. under 20 kPa until a desired softening point was reached to synthesize polyester resins B1 to B7. The softening temperature, the glass transition temperature, and the acid value of each of the resins are shown in Table 2.

TABLE 2

| | | Synthesis Examples | | | | | | |
|---|---|---|---|---|---|---|---|---|
| | | 6 | 7 | 8 | 9 | 10 | 11 | 12 |
| Polyester resin No. | | B1 | B2 | B3 | B4 | B5 | B6 | B7 |
| Alcohol component | BPA-PO* | 517 g | 517 g | — | — | 258 g | 517 g | 517 g |
| | BPF-PO* | — | — | 380 g | 380 g | — | — | — |
| | 1,2-propanediol | — | — | 23 g | 23 g | 57 g | — | — |

TABLE 2-continued

| | | Synthesis Examples | | | | | | |
|---|---|---|---|---|---|---|---|---|
| | | 6 | 7 | 8 | 9 | 10 | 11 | 12 |
| Carboxylic acid component | terephthalic acid | 125 g | 125 g | 125 g | 125 g | 150 g | 125 g | 150 g |
| | Itaconic acid | 78 g | 78 g | 78 g | 78 g | 39 g | 78 g | 39 g |
| | Trimellitic anhydride | 144 g | 144 g | 144 g | 144 g | 173 g | 144 g | 173 g |
| Esterification catalyst | tin (II) 2-ethylhexanoate | 6 g | 4 g | 4 g | 4 g | 4 g | 8 g | 4 g |
| Amount of bisphenol compound contained in alcohol component (mole %) | | 100 | 100 | 80 | 80 | 50 | 100 | 100 |
| Physical properties of polyester resin | Softening temperature (° C.) | 155.4 | 112.0 | 90.2 | 87.9 | 111.7 | 162.3 | 118.5 |
| | Glass transition temperature (° C.) | 68.2 | 61.5 | 60.2 | 59.8 | 60.3 | 69.5 | 62.1 |
| | Acid value (mgKOH/g) | 10.2 | 10.4 | 5.6 | 6.7 | 13.3 | 13.5 | 27.8 |

*BPA-PO: propylene oxide adduct of bisphenol A; polyoxypropylene (2.2)-2,2-bis(4-hydroxyphenyl)propane
*BPF-PO: propylene oxide adduct of bisphenol F; polyoxypropylene (2.2)-2,2-bis(4-hydroxyphenyl)methane

Examples 1 to 13 and Comparative Examples 1 to 4

Production of Toners 1 to 17

Components of the combination of a binder resin, a releasing agent, a colorant, and abietic acid, whose type and formulation amount shown in Tables 3-1 and 3-2, were premixed using a HENSCHEL MIXER (manufactured by Mitsui Miike Kakouki Co., Ltd., FM10B) and melted and kneaded with a biaxial kneader (manufactured by IKEGAI, LTD., PCM-30) at a temperature of 100° C. to 130° C. The resulting kneaded product was cooled to the room temperature and then coarsely crushed to particle sizes of 200 μm to 300 μm with a hammer mill. Next, the crushed particles were finely pulverized by a supersonic jet pulverizer (LABOJET manufactured by Nihon Pneumatic Industry Co., Ltd.) while appropriately adjusting a pulverizing air pressure so as to have mass average particle diameters of 8.2 μm±0.3 μm, and then classified by an air classifier (manufactured by Nihon Pneumatic Industry Co., Ltd., MDS-I) while appropriately adjusting its louver opening so that the mass average particle diameters were 9.0 μm±0.2 μm and the amount of fine powder particles having particle diameters of 4 μm or less was 10% by number or less to obtain toner base particles. Next, an additive (HDK-2000, produced by Clariant Japan K.K.) in an amount of 1.0 part by mass to 100 parts by mass of the toner base particles was stirred and mixed with each other in a HENSCHEL MIXER, thereby producing Toners 1 to 17, respectively.

TABLE 3-1

| | Toner | Binder Resin: Polyester resin (A) | | Polyester resin (B) | | Releasing agent | | Colorant | | Abietic acid |
|---|---|---|---|---|---|---|---|---|---|---|
| Ex. 1 | Toner 1 | Resin A1 | 50 parts | Resin B1 | 50 parts | carnauba wax | 5 parts | C.I. Pigment blue 15:3 | 6 parts | 0 parts |
| Ex. 2 | Toner 2 | Resin A1 | 50 parts | Resin B2 | 50 parts | carnauba wax | 5 parts | C.I. Pigment blue 15:3 | 6 parts | 0 parts |
| Ex. 3 | Toner 3 | Resin A1 | 50 parts | Resin B3 | 50 parts | carnauba wax | 5 parts | C.I. Pigment blue 15:3 | 6 parts | 0 parts |
| Ex. 4 | Toner 4 | Resin A2 | 50 parts | Resin B1 | 50 parts | carnauba wax | 5 parts | C.I. Pigment blue 15:3 | 6 parts | 0 parts |
| Ex. 5 | Toner 5 | Resin A4 | 50 parts | Resin B1 | 50 parts | carnauba wax | 5 parts | C.I. Pigment blue 15:3 | 6 parts | 0.1 parts |
| Ex. 6 | Toner 6 | Resin A1 | 90 parts | Resin B1 | 10 parts | carnauba wax | 5 parts | C.I. Pigment blue 15:3 | 6 parts | 0 parts |
| Ex. 7 | Toner 7 | Resin A1 | 40 parts | Resin B1 | 60 parts | carnauba wax | 5 parts | C.I. Pigment blue 15:3 | 6 parts | 0 parts |
| Ex. 8 | Toner 8 | Resin A1 | 30 parts | Resin B1 | 70 parts | carnauba wax | 5 parts | C.I. Pigment blue 15:3 | 6 parts | 0 parts |
| Ex. 9 | Toner 9 | Resin A1 | 50 parts | Resin B4 | 50 parts | carnauba wax | 5 parts | C.I. Pigment blue 15:3 | 6 parts | 0 parts |
| Ex. 10 | Toner 10 | Resin A1 | 50 parts | Resin B5 | 50 parts | carnauba wax | 5 parts | C.I. Pigment blue 15:3 | 6 parts | 0 parts |
| Ex. 11 | Toner 11 | Resin A1 | 50 parts | Resin B6 | 50 parts | carnauba wax | 5 parts | C.I. Pigment blue 15:3 | 6 parts | 0 parts |
| Ex. 12 | Toner 12 | Resin A1 | 50 parts | Resin B7 | 50 parts | carnauba wax | 5 parts | C.I. Pigment blue 15:3 | 6 parts | 0 parts |
| Ex. 13 | Toner 13 | Resin A5 | 50 parts | Resin B1 | 50 parts | carnauba wax | 5 parts | C.I. Pigment blue 15:3 | 6 parts | 0 parts |

"Part" means "part by mass".

TABLE 3-2

| | Toner | Binder Resin: Polyester resin (A) | | Binder Resin: Polyester resin (B) | | Releasing agent | | Colorant | | Abietic acid |
|---|---|---|---|---|---|---|---|---|---|---|
| Comp. Ex. 1 | Toner 14 | Resin A1 | 100 parts | — | — | carnauba wax | 5 parts | C.I. Pigment blue 15:3 | 6 parts | 0 parts |
| Comp. Ex. 2 | Toner 15 | Resin A3 | 50 parts | Resin B1 | 50 parts | carnauba wax | 5 parts | C.I. Pigment blue 15:3 | 6 parts | 0 parts |
| Comp. Ex. 3 | Toner 16 | Resin A4 | 50 parts | Resin B3 | 50 parts | carnauba wax | 5 parts | C.I. Pigment blue 15:3 | 6 parts | 0 parts |
| Comp. Ex. 4 | Toner 17 | Resin A4 | 50 parts | Resin B3 | 50 parts | carnauba wax | 5 parts | C.I. Pigment blue 15:3 | 6 parts | 1.5 parts |

"Part" means "part by mass"

—Preparation of Carrier—

According to the following coating material formulation, components were dispersed by a stirrer for 10 minutes to prepare a coating liquid. This coating liquid and 5,000 parts by mass of a core material (Cu—Zn ferrite particle, mass average particle diameter=80 μm) were loaded into a coating device for coating while forming a spinning stream, equipped with a fluidized bed, a rotary bottom plate disc and a stirring blade disc arranged in the fluidized bed, and the core material was coated with the coating liquid. The resulting coated core material was baked in an electric furnace at 280° C. for 2 hours to prepare a carrier.

| [Composition of coating material] | |
|---|---|
| toluene | 450 parts by mass |
| silicone resin (SR2400, produced by TORAY Dow Corning Silicone Co., Ltd., nonvolatile content: 50% by mass) | 450 parts by mass |
| aminosilane (SH6020, produced by TORAY Dow Corning Silicone) | 10 parts by mass |
| carbon black | 10 parts by mass |

—Preparation of Two-Component Developer—

Each of 5% by mass of toners 1 to 17 thus obtained and 95% by mass of the carrier thus obtained were uniformly mixed and triboelectrically charged using a tubular mixer (manufactured by Willy A. Bachofen (WAB) AG Maschinenfabrik), in which stirring is carried out in a rolling container, at 48 rpm for 5 minutes to prepare two-component developers 1 to 17.

—Evaluation of Performance—

Next, Toners 1 to 17 of Examples and Comparative Examples were evaluated for hue, smear resistance on developing roller, heat resistant storage stability, cold offset resistance, hot offset resistance, and abietic acid content of the toner as follows. The evaluation results are shown in Table 4.

Note that hue, smear resistance on developing roller, cold offset resistance, and hot offset resistance were evaluated after each of the developers 1 to 17 of Examples and Comparative Examples had been put in an image forming apparatus.

Here, as the image forming apparatus, a remodeled machine of a super-high-speed digital laser printer, IPSIO SP9500PRO (manufactured by Ricoh Company Ltd., printing speed: 156 sheets/min (A4 size paper sheet, fed into the printing section from its longer side) employing a two-component developing method and a direct transfer method and a heat roller fixing method was used.

<Hue Evaluation>

Each of the developers was loaded into a super-high-speed digital laser printer, IPSIO SP9500PRO (manufactured by Ricoh Company, Ltd.), and a solid image having a size of 1 cm square was formed on a transfer sheet of thin paper (produced by NBS Ricoh Co., Ltd., copy print paper <55>) with a toner adhesion amount of 0.40 mg/cm$^2$±0.1 mg/cm$^2$, using a fixing roller temperature of 170° C. The spectral reflection properties of each fixation sample were measured with a spectral photometer (UV3100, manufactured by Shimadzu Corporation). At this time, reflection properties such as the rising of reflection range, the reflectance and the wavelength thereof, and the difference between absorption and reflection were measured for confirming the hue and saturation evaluation.

[Evaluation Criteria]

A: Excellent hue and saturation

B: Relatively good hue and saturation

C: Slightly poor hue and saturation (which is on the same level as those of conventional toners)

D: Bad hue and saturation

<Smear Resistance on Developing Roller>

Each of the developers was loaded into a remodeled machine of a super-high-speed digital laser printer, IPSIO SP9500PRO (manufactured by Ricoh Company, Ltd.), and a running printing test of 100,000 sheets was performed using an image chart having an image area ratio of 5%. After the running printing test, the developer and toner on the developing roller were removed therefrom, and the evaluation for smear resistance on developing roller was carried out by visually observing smear on the surface of the developing roller in the paper passing part.

[Evaluation Criteria]

A: No smear observed on the developing roller.

B: A slight amount of smear occurred, but it was difficult to visually distinguish.

C: A small amount of smear occurred (which is on the same level as those of conventional toners).

D: Considerable smear occurred.

E: Considerable smear occurred and it was difficult to put into practical use.

<Heat Resistant Storage Stability>

The heat resistant storage stability was measured using a needle penetration tester (manufactured by Nihon Kagaku Engineering K.K.). More specifically, each of the toners was weighed in an amount of 10 g and put in a 30 ml glass vial (screw vial) under an environment of a temperature of 20° C. to 25° C. and a relative humidity of 40% to 60% and the vial was sealed with a lid. The glass vial containing the toner was tapped 200 times and then left standing in a thermostatic bath maintained at a temperature of 50° C. for 48 hours. Then, a degree of penetration was measured by the needle penetration tester, and the evaluation for heat resistant storage stability was carried out according to the following criteria. The greater the value of degree of penetration is, the more excellent heat resistant storage stability is.

[Evaluation Criteria]

A: The degree of penetration was 30 mm or more.

B: The degree of penetration was 20 mm to 29 mm.

C: The degree of penetration was 15 mm to 19 mm (which is as same as the rates of penetration obtained from conventional toners).

D: The degree of penetration was 8 mm to 14 mm.

E: The degree of penetration was 7 mm or less.

<Cold Offset Resistance>

Each of the developers was loaded into a super-high-speed digital laser printer, IPSIO SP9500PRO (manufactured by Ricoh Company, Ltd.), and a solid image having a size of 1 cm square was formed on a transfer sheet of heavy paper (produced by NBS Ricoh Co., Ltd., copy print paper <135>) with a toner adhesion amount of 0.20 mg/cm$^2$±0.1 mg/cm$^2$. A "Scotch Mending Tape 810" (tape width=24 mm, produced by Sumitomo 3M Ltd.) was attached on the solid image, and a metal roller (manufactured by SUS Corporation; diameter=50 mm) having a weight of 1 kg was rolled back and forth 10 times over the tape at a rolling speed of 10 mm/s. The tape was peeled off in a given direction at a speed of 10 mm/s, and an image residual rate was determined from the results of image density before and after the tape peeling off, using the following Equation (ii), and the cold offset resistance was evaluated according to the following evaluation criteria.

$$\text{Image Residual Rate}(\%)=(\text{Image density after tape peeling}/\text{Image density before tape peeling})\times 100 \quad \text{Equation (ii)}$$

[Evaluation Criteria]

A: The image residual rate was 97% or more.

B: The image residual rate was 92% or more and less than 97%.

C: The image residual rate was 80% or more and less than 92% (which is as same as the image rates obtained from conventional toners).

D: The image residual rate was less than 80%.

<Hot Offset Resistance>

Each of the developers was loaded into a super-high-speed digital laser printer, IPSIO SP9500PRO (manufactured by Ricoh Company, Ltd.), and a solid image having a size of 1 cm square was formed on a transfer sheet of thin paper (produced by NBS Ricoh Co., Ltd., copy print paper <55>) with a toner adhesion amount of 0.40 mg/cm$^2$±0.1 mg/cm$^2$. The image was fixed while varying the fixing roller temperature, and presence or absence of hot offset was visually observed. An upper limit temperature at which no hot offset occurred was determined as an upper limit fixing temperature, and the hot offset resistance was evaluated according to the following evaluation criteria.

[Evaluation Criteria]

A: The upper limit fixing temperature was 240° C. or more.

B: The upper limit fixing temperature was 220° C. or more and less than 240° C.

C: The upper limit fixing temperature was 180° C. or more and less than 220° C. (which is as same as the upper limit temperatures of conventional toners).

D: The upper limit fixing temperature was less than 180° C.

TABLE 4

| | Toner | Hue | Smear resistance on developing roller | Heat resistant storage stability | Cold offset resistance | Hot offset resistance | Amount of abietic acid in toner (% by mass) |
|---|---|---|---|---|---|---|---|
| Ex. 1 | Toner 1 | A | B | A | B | A | 0.1 |
| Ex. 2 | Toner 2 | A | A | B | B | B | 0.11 |
| Ex. 3 | Toner 3 | A | B | B | A | B | 0.11 |
| Ex. 4 | Toner 4 | B | A | A | C | B | 0.02 |
| Ex. 5 | Toner 5 | C | B | B | B | B | 0.015 |
| Ex. 6 | Toner 6 | B | C | C | A | C | 0.18 |
| Ex. 7 | Toner 7 | B | A | B | B | B | 0.09 |
| Ex. 8 | Toner 8 | B | A | A | C | A | 0.07 |
| Ex. 9 | Toner 9 | B | B | B | C | B | 0.1 |
| Ex. 10 | Toner 10 | B | C | C | B | C | 0.11 |
| Ex. 11 | Toner 11 | B | B | A | B | B | 0.09 |
| Ex. 12 | Toner 12 | B | B | B | B | B | 0.1 |
| Ex. 13 | Toner 13 | A | C | C | B | C | 0.9 |
| Comp. Ex. 1 | Toner 14 | B | D | C | B | C | 0.2 |
| Comp. Ex. 2 | Toner 15 | C | B | B | D | B | 0.01 |
| Comp. Ex. 3 | Toner 16 | D | B | C | B | B | 0.008 |
| Comp. Ex. 4 | Toner 17 | B | E | D | B | D | 1.4 |

The results shown in Table 4 demonstrated that as compared to Comparative Examples 1 to 4, Examples 1 to 13 are more capable of achieving low-temperature fixability, offset resistance and heat resistant storage stability, further, achieve excellent dispersibility of pigments, and have noteworthy smear resistance on developing roller and the like, wherein the level of the capability of achieving low-temperature fixability, offset resistance, and heat resistant storage ability is such that the capability can be used in the super-high-speed image forming systems.

The toner and the developer of the present invention are favorably used in super-high-speed printing systems which can be used, for example, in print-on-demand (POD) technology especially using an electrophotographic printing method, because they are capable of achieving low-temperature fixability, offset resistance, and heat resistant storage stability, further, achieve excellent dispersibility of pigments, and have remarkable effect of improving smear resistance on developing roller and the like, wherein the level of the capability of achieving low-temperature fixability, offset resistance, and heat resistant storage ability is such that the capability can be used in the super-high-speed image forming systems.

What is claimed is:

1. A toner comprising:

a binder resin, a releasing agent, and a colorant, wherein the binder resin comprises a polyester resin (A) and a polyester resin (B), wherein the polyester resin (A) is produced by polycondensing an alcohol component not containing an alkylene oxide adduct of bis-phenol A with a carboxylic acid component which contains a rosin compound in an amount of 5% by mass or more of the total amount by mass of the alcohol component and the carboxylic acid component, wherein the polyester resin (B) is produced by polycondensing an alcohol component containing an alkylene oxide adduct of bisphenol A represented by General Formula (1) given below and an aliphatic diol with a carboxylic acid component, and wherein the rosin compound includes abietic acid, the polyester resin (A) includes polycondensed units of abietic acid derived from the rosin compound, and the toner contains abietic acid derived from the rosin compound other than the polycondensed units of abietic acid in the polyester resin (A), and wherein the toner contains abietic acid in an amount of 0.01% by mass to 1% by mass based on the total mass of the toner:

General Formula (1)

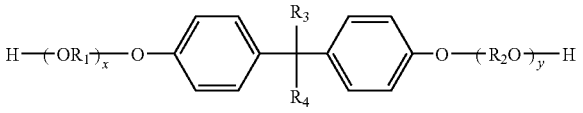

where $R_1$ and $R_2$ each represent a C2-C4 alkylene group; $R_3$ and $R_4$ are each any one of a hydrogen atom, a C1-C6 straight-chain alkyl group, and a C1-C6 branched-chain alkyl group; and x and y each represent a positive integer and the sum of x and y is 1 to 16.

2. The toner according to claim 1, wherein the alcohol component of the polyester resin (A) contains an aliphatic diol in an amount of 65 mole % or more of a divalent alcohol component.

3. The toner according to claim 2, wherein the aliphatic diol contains 1,2-propanediol in an amount of 65 mole % or more.

4. The toner according to claim 1, wherein the carboxylic acid component of the polyester resin (A) further contains an aromatic dicarboxylic acid compound.

5. The toner according to claim 1, wherein the polyester resin (B) is produced by polycondensing an alcohol component which contains the alkylene oxide adduct of bisphenol A represented by General Formula (1) in an amount of 80 mole % or more of a divalent alcohol component with a carboxylic acid component.

6. The toner according to claim 1, wherein the polyester resin (A) has an acid value of 25 mgKOH/g to 70 mgKOH/g and the polyester resin (B) has an acid value of 1 mgKOH/g to 25 mgKOH/g.

7. The toner according to claim 1, wherein a mass ratio [(B)/(A)] of the polyester resin (B) to the polyester resin (A) is 1/9 to 6/4.

8. The toner according to claim 1, wherein the polyester resin (A) contains a low-molecular-weight component having a molecular weight of 500 or less in an amount of 12% or lower based on the weight of the polyester resin (A).

9. The toner according to claim 1, wherein the carboxylic acid component of the polyester resin (B) includes at least one aromatic polyvalent carboxylic acid selected from the group consisting of phthalic acid, isophthalic acid, terephthalic acid and trimellitic acid in an amount of 40 mole % to 95 mole % based on the moles of the aromatic polyvalent carboxylic acid.

10. An image comprising the toner of claim 1 formed on a paper substrate.

11. A method for forming an image comprising electrophotographically printing an image comprising the toner of claim 1 on a paper substrate.

12. A developer comprising:

a toner, and a carrier, wherein the toner comprises a binder resin, a releasing agent, and a colorant, wherein the binder resin comprises a polyester resin (A) and a polyester resin (B), wherein the polyester resin (A) is produced by polycondensing an alcohol component not containing an alkylene oxide adduct of bis-phenol A with a carboxylic acid component which contains a rosin compound in an amount of 5% by mass or more of the total amount by mass of the alcohol component and the carboxylic acid component, wherein the polyester resin (B) is produced by polycondensing an alcohol component containing an alkylene oxide adduct of bisphenol A represented by General Formula (1) given below and an aliphatic diol with a carboxylic acid component, and wherein the rosin compound includes abietic acid, the polyester resin (A) includes polycondensed units of abietic acid derived from the rosin compound, and the toner contains abietic acid derived from the rosin compound other than the polycondensed units of abietic acid in the polyester resin (A), and wherein the toner contains abietic acid in an amount of 0.01% by mass to 1% by mass based on the total mass of the toner:

General Formula (1)

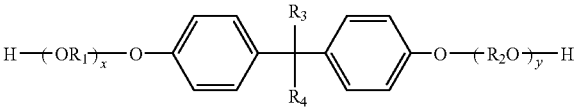

where $R_1$ and $R_2$ each represent a C2-C4 alkylene group; $R_3$ and $R_4$ are each any one of a hydrogen atom, a C1-C6 straight-chain alkyl group, and a C1-C6 branched-chain alkyl group; and x and y each represent a positive integer and the sum of x and y is 1 to 16.

13. The developer according to claim 12, wherein the carboxylic acid component of the polyester resin (B) includes at least one aromatic polyvalent carboxylic acid selected from the group consisting of phthalic acid, isophthalic acid, terephthalic acid and trimellitic acid in an amount of 40 mole % to 95 mole % based on the moles of the aromatic polyvalent carboxylic acid.

* * * * *